US007824229B1

(12) United States Patent
Yang et al.

(10) Patent No.: US 7,824,229 B1
(45) Date of Patent: Nov. 2, 2010

(54) AUDIO PLUG CONNECTOR

(75) Inventors: Chih-Lin Yang, Tu-Cheng (TW); Hsin-Tsung Ho, Tu-Cheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/500,731

(22) Filed: Jul. 10, 2009

(51) Int. Cl.
*H01R 24/04* (2006.01)

(52) U.S. Cl. ..... 439/669; 439/924.1

(58) Field of Classification Search ..... 439/668, 439/669, 66, 924.1
See application file for complete search history.

(56) References Cited

U.S. PATENT DOCUMENTS 3,078,436 A * 2/1963 Berry ..... 439/579
5,055,068 A * 10/1991 Machura et al. ..... 439/581
5,102,353 A * 4/1992 Brunker et al. ..... 439/607.08
5,190,461 A * 3/1993 Oorui et al. ..... 439/63
5,234,353 A * 8/1993 Scholz et al. ..... 439/289
5,238,413 A * 8/1993 McCaffrey et al. ..... 439/79
5,334,055 A * 8/1994 Sato et al. ..... 439/723
5,439,394 A * 8/1995 Ikeda ..... 439/675
5,454,734 A * 10/1995 Eggert et al. ..... 439/578
5,538,435 A * 7/1996 Yohn ..... 439/188
5,584,713 A * 12/1996 Kato et al. ..... 439/188
5,658,154 A * 8/1997 Bumsted et al. ..... 439/79
5,718,592 A * 2/1998 Hosler et al. ..... 439/63
5,885,088 A * 3/1999 Brennan et al. ..... 439/680
5,971,880 A * 10/1999 Keiser ..... 475/83
6,186,833 B1 * 2/2001 Wu ..... 439/668
6,203,344 B1 * 3/2001 Ito ..... 439/218
6,439,926 B1 * 8/2002 Kuan ..... 439/607.4
6,461,198 B1 * 10/2002 Chao ..... 439/668
6,616,487 B1 * 9/2003 Lai ..... 439/668
6,716,064 B2 * 4/2004 Kubo ..... 439/607.23
6,786,778 B2 * 9/2004 Lai ..... 439/701
6,964,586 B2 * 11/2005 Siddiqui ..... 439/669

* cited by examiner

*Primary Examiner*—Neil Abrams

(57) ABSTRACT

An audio plug connector for mating with an audio jack connector, includes a main member of substantially cylindrical shape with a plurality of contacts exposed along an axis direction thereof. A subsidiary member is extended from a portion of an outer peripheral surface of the main member and defines at least one terminal groove at a side surface thereof. The terminal groove extends substantially parallel with the axis direction of the main member. A front end of the terminal groove is hooked into an inside of the subsidiary member to form a fixing cavity. At least one conductive terminal is received in the corresponding terminal groove with a rear end thereof extending out of a rear end of the terminal groove. A front end of the conductive terminal is bent rearward to form a hook portion hooked into the corresponding fixing cavity.

7 Claims, 3 Drawing Sheets

AUDIO PLUG CONNECTOR

BACKGROUND OF THE INVENTION

1. Field of the Invention

The present invention relates to an electrical connector, and more particularly to an audio plug connector.

2. The Related Art

Plug and jack type connectors are widely used for connecting audio equipments. The plug and jack connectors only transmit sound signals in an earlier stage due to the limitations of their structures. Later on, a number of independent terminals are provided on the plug connector for transmitting other signals. A conventional audio plug connector includes an insulating housing which retains an audio plug and also defines a plurality of terminal grooves for receiving a plurality of corresponding independent terminals therein. The terminal has a substantially strip shaped contact portion for being electrically connected with a mated terminal of a mated audio jack connector.

While the audio plug connector is electrically connected with the mated audio jack connector, a free end of contact portion of the terminal would likely be tilted out of the terminal groove due to an interference between the terminal and the mated terminal of the audio jack connector. Besides, the terminals have a tendency to slide rearward because they are subject to a backward force from the mated terminals during the insertion. As a result, the terminals received in the terminal grooves may be unstably after the audio plug connector is inserted in and pulled out the audio jack connector several times. These will cause a bad effect to the audio plug connector and sequentially influence the signal transmission.

SUMMARY OF THE INVENTION

It is an object of the present invention to provide an audio plug connector having an improved terminal capable of being firmly fixed thereto. The audio plug connector includes a main member of substantially cylindrical shape with a plurality of contacts exposed along an axis direction thereof and a subsidiary member extended from a portion of an outer peripheral surface of the main member. The subsidiary member defines at least one terminal groove at a side surface thereof. The terminal groove extends substantially parallel with the axis direction of the main member to penetrate a front end which is firstly inserted into a mated audio jack connector and a rear end of the subsidiary member. A front end of the terminal groove is hooked into an inside of the subsidiary member to form a fixing cavity. At least one conductive terminal of strip shape is received in the corresponding terminal groove. A rear end of the conductive terminal extends out of a rear end of the terminal groove, while a front end of the conductive terminal is bent rearward to form a hook portion hooked into the corresponding fixing cavity of the subsidiary member.

As described above, because the hook portion is hooked into the fixing cavity, the conductive terminal is fixed in the terminal groove securely. So the conductive terminal will not be tilted outside or relatively slide in the terminal groove, and the audio plug connector can provide a stable transmission effect.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
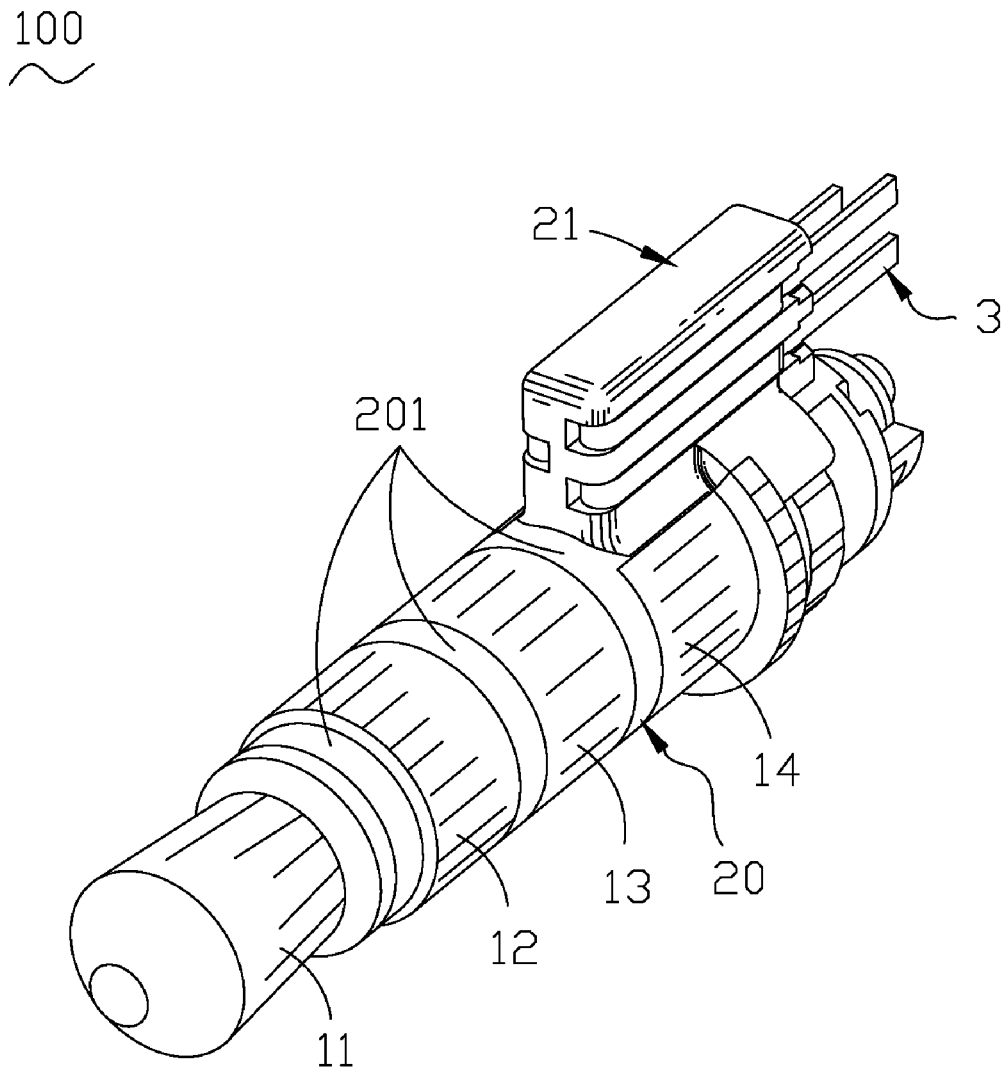
FIG. 1 is a perspective view of an audio plug connector in accordance with the present invention.
Figure 2:
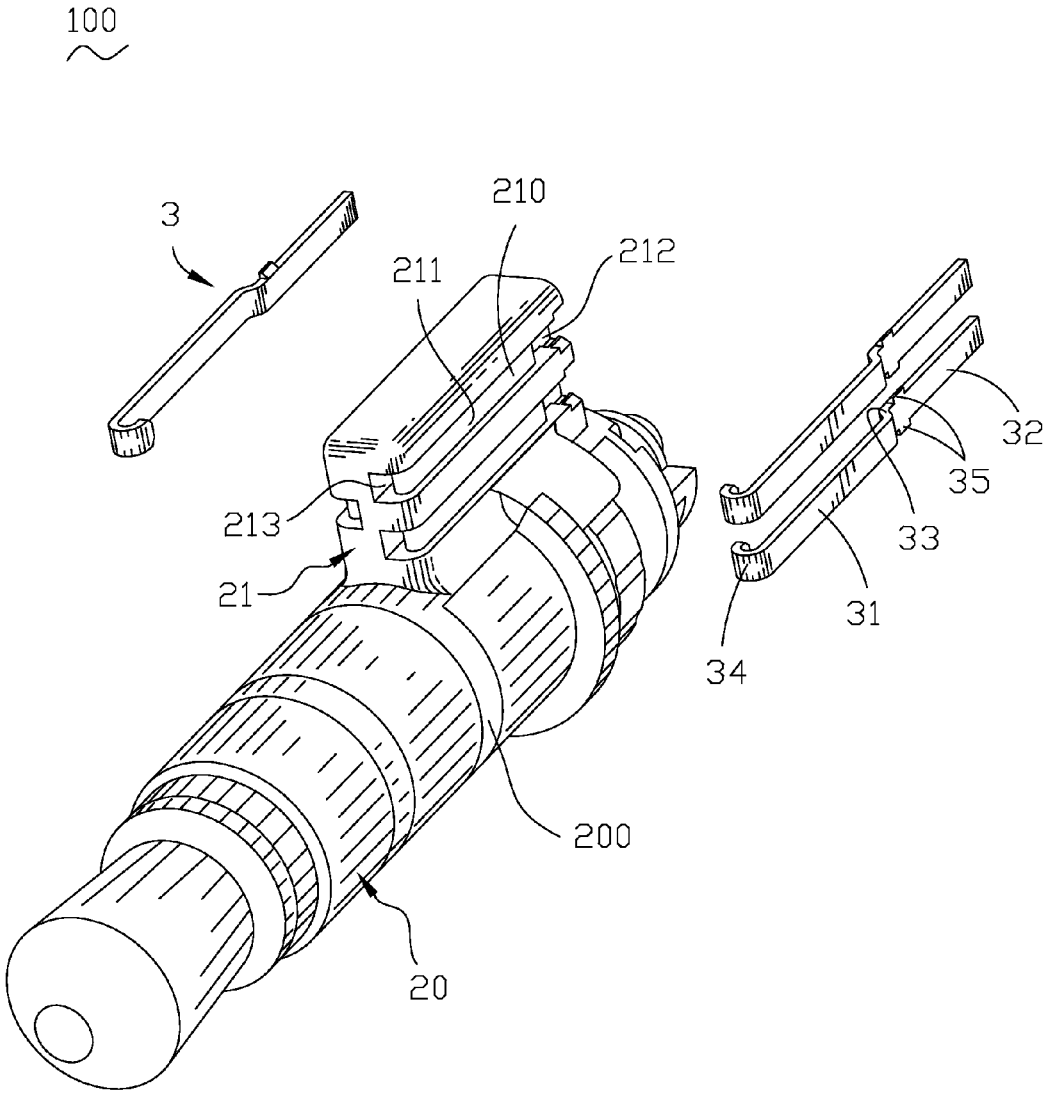
FIG. 2 is a partially exploded view of the audio plug connector as shown in FIG. 1 with conductive terminals not assembled to the audio plug.

Referring to FIG. 1 and FIG. 2, an audio plug connector 100 according to the present invention includes a main member 20 of substantially cylindrical shape with a plurality of contacts 11, 12 13, 14 exposed along an axis direction thereof for transmitting sound signals. The contacts 11, 12, 13, 14 are insulated from each other by insulators 201 which are formed at the main member 20. A subsidiary member 21 is extended from a rear portion of an outer peripheral surface 200 of the main member 20 to show substantially rectangular board shape. The subsidiary member 21 retains a plurality of conductive terminals 3.

Figure 3:
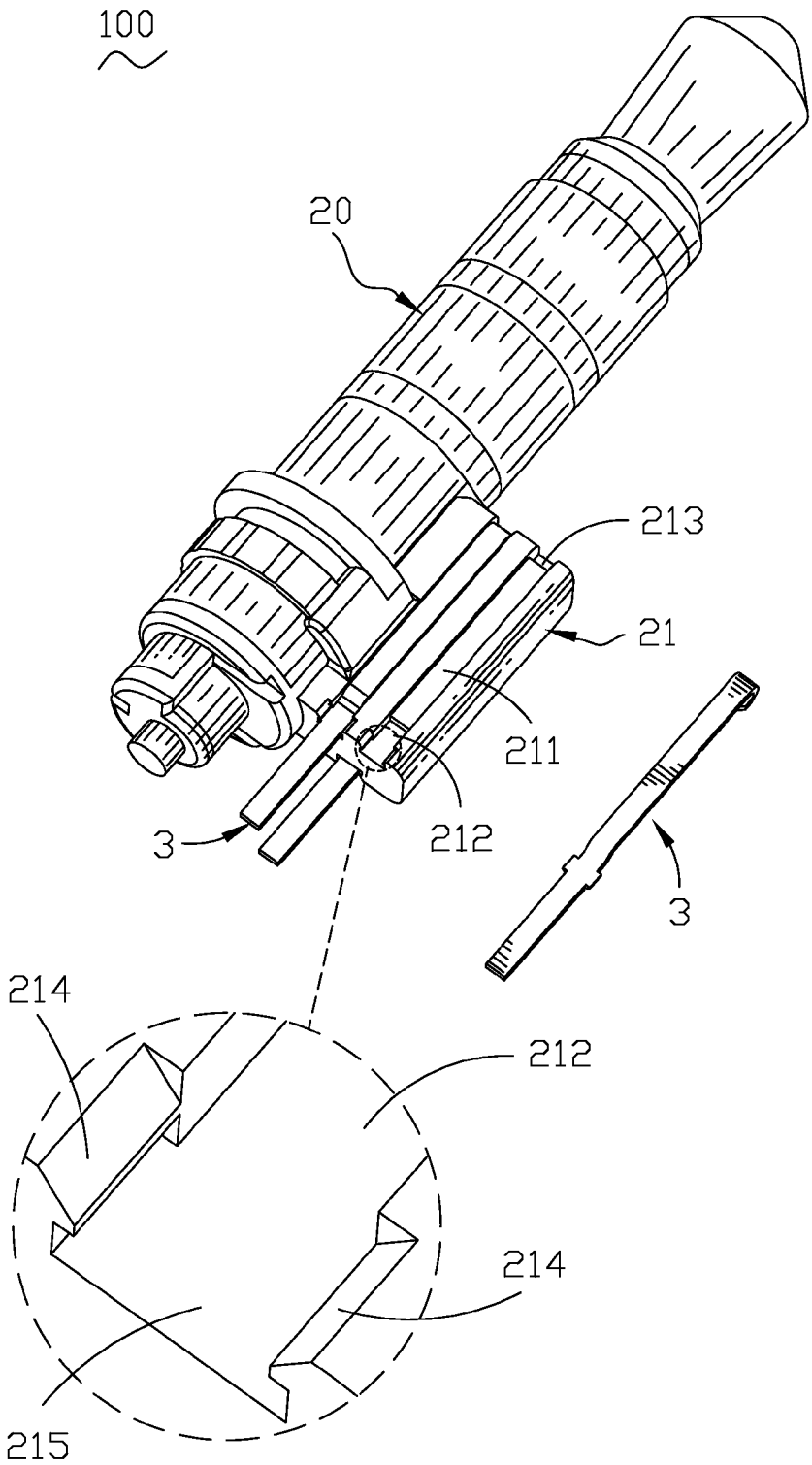
FIG. 3 shows another partially exploded view of the audio plug connector.

The subsidiary member 21 defines a plurality of terminal grooves 210 for receiving the conductive terminals 3. In this embodiment, the subsidiary member 21 defines three terminal grooves 210 arranged in stagger at two opposing side surfaces thereof which are substantially perpendicularly connected to the outer peripheral surface 200 of the main member 20. The terminal groove 210 extends substantially parallel with the axis direction of the main member 20 to penetrate a front end which is firstly inserted into a mated audio jack connector (not shown) and a rear end of the subsidiary member 21. Each of the terminal grooves 210 includes a front groove 211 and a rear groove 212 deeper than the front groove 211. A front end of the front groove 211 is hooked into an inside of the subsidiary member 21 to form a fixing cavity 213. As best shown in FIG. 3, two opposite sides of the rear groove 212 are respectively cut to form an inclined guide surface 214 at an upper portion thereof and a limiting recess 215 at a lower portion thereof.

With reference with FIG. 2 again, the audio plug connector 100 of this embodiment includes three independent conductive terminals 3 corresponding to the three terminal grooves 210. Each conductive terminal 3 is of strip shape and divided into a front contact portion 31, a rear solder portion 32 with a small drop from the contact portion 31, and a middle bent portion 33 connecting the contact portion 31 and the solder portion 32. A front end of the contact portion 31 is bent rearward to form a hook portion 34 located at the same side as the solder portion 32 with respect to the contact portion 31. Two sides of a front portion of the solder portion 32 protrude opposite to form two wedges 35.

Referring to FIG. 2 and FIG. 3, during the assembly of the conductive terminals 3, the hook portion 34 is hooked into the fixing cavity 213 first. After that, a fixture is used to press down the free end of the solder portion 32. When the wedges 35 touch the inclined guide surfaces 214, the inclined guide surfaces 214 guide the wedges 35 to slide downwardly and finally into the limiting recess 215 to make sure the conductive terminal 3 is securely fixed in the terminal groove 210. In this case, the contact portion 31 is received in the front groove 211, the hook portion 34 is hidden in the fixing cavity 213, the wedges 35 are jammed in the limiting recess 215, and the solder portion 32 is extended beyond the rear groove 212 for being soldered to a PCB (not shown).

While the audio plug connector 100 is electrically connected with the mated audio jack connector, because the front end of the contact portion 31 is bent to form into the hook portion 34 embedded in the fixing cavity 213 to be invisible, the circumstance that the contact portion 31 is tilted out of terminal groove 210 can be avoided during the audio plug connector 100 is inserted in the audio jack connector. Besides, when the hook portion 34 is hooked into the fixing cavity 213 and wedges 35 are jammed in the limiting recess 215, it will avoid the relative movement of the conductive terminal 3 in the terminal groove 210. So the conductive terminal 3 can be securely fixed in the terminal groove 210 even though the audio plug connector 100 is inserted in and draw out the audio jack connector frequently. Thus, the audio plug connector 100 in accordance with the present invention can provide a stable signal transmission.

As described above, when the hook portion 34 is hooked into the fixing cavity 213 and the wedges 35 are jammed in the limiting recess 215, it will ensure the conductive terminal 3 to be fixed in the terminal groove 210 firmly, and therefore prevent the terminal 3 from being tilted outside or relatively sliding in the terminal groove 210.

What is claimed is:

1. An audio plug connector for mating with an audio jack connector, comprising:

a main member of substantially cylindrical shape with a plurality of contacts exposed along an axis direction thereof;

a subsidiary member extended from a portion of an outer peripheral surface of the main member, the subsidiary member defining at least one terminal groove at a side surface thereof, the terminal groove extending substantially parallel with the axis direction of the main member to penetrate a front end which is firstly inserted into the audio jack connector and a rear end of the subsidiary member, a front end of the terminal groove being hooked into an inside of the subsidiary member to form a fixing cavity; and at least one conductive terminal of strip shape received in the corresponding terminal groove, a rear end of the conductive terminal extending out of a rear end of the terminal groove, a front end of the conductive terminal being bent rearward to form a hook portion hooked into the corresponding fixing cavity of the subsidiary member.

2. The audio plug connector as claimed in claim 1, wherein the terminal groove is defined at one side surface substantially perpendicularly connected to the outer peripheral surface.

3. The audio plug connector as claimed in claim 2, wherein the subsidiary member has two parallel side surfaces substantially perpendicularly connected to the outer peripheral surface.

4. The audio plug connector as claimed in claim 1, wherein the conductive terminal is divided into a front contact portion, a rear solder portion with a small drop from the contact portion, and a middle bent portion connecting the contact portion and the solder portion.

5. The audio plug connector as claimed in claim 4, wherein the terminal groove includes a front groove for receiving the contact portion therein and a rear groove deeper than the front groove, the solder portion is received in the rear groove and extended rearward beyond the rear groove.

6. The audio plug connector as claimed in claim 5, wherein two opposite sides of the rear groove are respectively cut to form an inclined guide surface at an upper portion thereof and a limiting recess at a lower portion thereof, two sides of a portion of the solder portion protrude opposite to form two wedges for sliding into the limiting recess by guide of the inclined guide surfaces.

7. The audio plug connector as claimed in claim 1, wherein two opposite sides of a rear portion of the terminal groove are respectively cut to form an inclined guide surface at an upper portion thereof and a limiting recess at a lower portion thereof, two sides of a corresponding portion of the conductive terminal protrude opposite to form two wedges for sliding into the limiting recess by guide of the inclined guide surfaces.

* * * * *